US005933506A

United States Patent [19]

Aoki et al.

[11] Patent Number: 5,933,506

[45] **Date of Patent: *Aug. 3, 1999**

[54] TRANSMITTER-RECEIVER HAVING EAR-PIECE TYPE ACOUSTIC TRANSDUCING PART

[75] Inventors: Shigeaki Aoki, Yokosuka; Kazumasa Mitsuhashi, Zushi; Yutaka Nishino, Miura; Kohichi Matsumoto; Chikara Yuse, both of Yokosuka; Hiroyuki Matsui, Yokohama, all of Japan

[73] Assignee: Nippon Telegraph and Telephone Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/441,988

[22] Filed: May 16, 1995

[30] Foreign Application Priority Data

May 18, 1994 [JP] Japan ..... 6-103766
Aug. 29, 1994 [JP] Japan ..... 6-203977

[51] Int. Cl.[6] ..... H04R 25/00

[52] U.S. Cl. ..... 381/151; 381/57; 381/94.1; 381/122

[58] Field of Search ..... 381/92, 94, 98, 381/111, 122, 101, 102, 104, 119, 121, 151, 57, 94.1, 68.3, 68.6

[56] References Cited

U.S. PATENT DOCUMENTS

| | | | |
|---|---|---|---|
| 3,814,856 | 6/1974 | Dugan | 381/57 |
| 4,589,137 | 5/1986 | Miller | 381/92 |
| 5,058,171 | 10/1991 | Wurzer et al. | 381/94 |
| 5,125,032 | 6/1992 | Meister et al. | 381/183 |
| 5,193,117 | 3/1993 | Ono et al. | 381/71 |
| 5,259,035 | 11/1993 | Peters et al. | 381/94 |
| 5,295,193 | 3/1994 | Ono | 381/151 |
| 5,363,452 | 11/1994 | Anderson | 381/92 |
| 5,390,254 | 2/1995 | Adelman | 381/68.6 |
| 5,550,925 | 8/1996 | Hori et al. | 381/98 |
| 5,692,059 | 11/1997 | Kruger . | |
| 5,757,934 | 5/1998 | Yokoi . | |
| 5,790,684 | 8/1998 | Niino et al. . | |

FOREIGN PATENT DOCUMENTS

| | | | |
|---|---|---|---|
| 0 481 529 | 4/1992 | European Pat. Off. . | |
| 0 594 063 | 4/1994 | European Pat. Off. . | |
| 0108419 | 9/1978 | Japan | 381/92 |
| WO 94/24834 | 10/1994 | WIPO . | |

*Primary Examiner*—Curtis A. Kuntz
*Assistant Examiner*—Duc Nguyen
*Attorney, Agent, or Firm*—Pollock, Vande Sande & Amernick

[57] ABSTRACT

Ear-piece type acoustic transducing part is provided with a bone-conducted sound pickup microphone for picking up a bone-conducted sound, a directional microphone for picking up an air-conducted sound and an electro-acoustic transducer for transducing a received speech signal to a received speech sound. A transmitting-receiving circuit connected to the acoustic transducing part includes: a low-pass filter which permits the passage therethrough of low-frequency components in a bone-conducted sound signal from the bone-conducted sound pickup microphone; a high-pass filter which permits the passage therethrough of high-frequency components in an air-conducted sound signal from the directional microphone; first and second variable loss circuits which impart losses to the outputs from the low-pass filter and the high-pass filter, respectively; a comparison/control circuit which compares the output levels of the low-pass filter and the high-pass filter with predetermined first and second reference levels, respectively, and based on the results of comparison, controls losses that are set in the first and second variable loss circuits; and a combining circuit which combines the outputs from the first and second variable loss circuits into a speech sending signal.

21 Claims, 9 Drawing Sheets

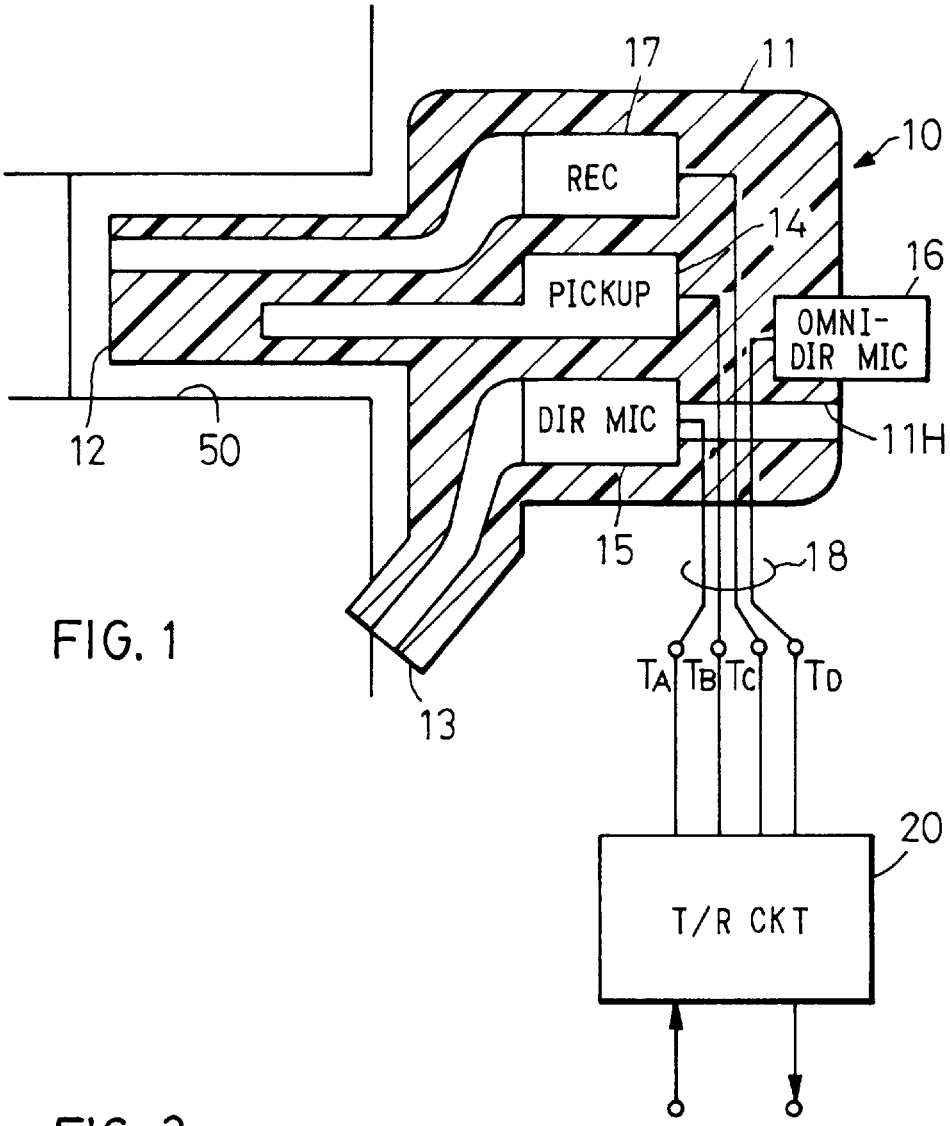
FIG. 1
FIG. 3
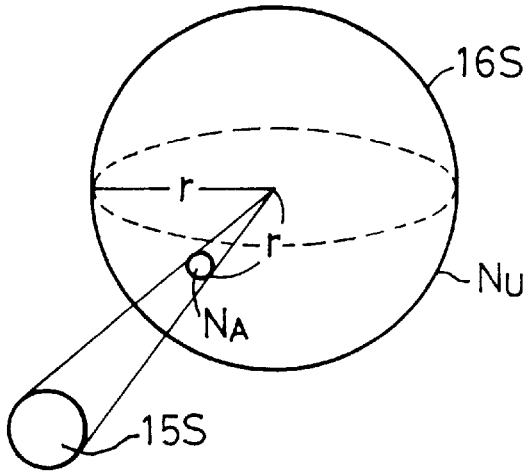

FIG. 4

| STATE | PRESENCE OR ABSENCE OF SIGNAL | | CONTROL OPERATIONS | |
|---|---|---|---|---|
| | LPF OUTPUT | HPF OUTPUT | LOSS BY 25B | LOSS BY 25A |
| 1 | ○ | ○ | MAINTAIN SET VALUE OF THE PRECEDING STATE | MAINTAIN SET VALUE OF THE PRECEDING STATE |
| 2 | ○ | × | INCREASE LOSS $L_B$ FROM $L_{B0}$ ACCORDING TO $V_B$ | SET INITIAL VALUE $L_{A0}$ |
| 3 | × | ○ | SET INITIAL VALUE $L_{B0}$ | INCREASE LOSS $L_A$ FROM $L_{A0}$ ACCORDING TO $V_A$ |
| 4 | × | × | SET INITIAL VALUE $L_{B0}$ | SET INITIAL VALUE $L_{A0}$ |

○: PRESENCE ×: ABSENCE

| | RECEIVING SIG | AIR COND SOUND | BONE COND SOUND | |
|---|---|---|---|---|
| 1 LISTENING STATE | ○ | × | × | USE FIG.7 |
| 2 SILENT STATE | × | × | × | |
| 3 TALKING STATE | × | ○ | ○ | USE FIG.8 |
| 4 DOUBLE-TALK STATE | ○ | ○ | ○ | |

× : ABSENCE ○ : PRESENCE

TRANSMITTER-RECEIVER HAVING EAR-PIECE TYPE ACOUSTIC TRANSDUCING PART

TECHNICAL FIELD

The present invention relates to a transmitter-receiver which comprises an ear-piece type acoustic transducing part having a microphone and a receiver formed as a unitary structure and a transmitting-receiving circuit connected to the acoustic transducing part and which permits hands-free communications. More particularly, the invention pertains to a transmitter-receiver which has an air-conducted sound pickup microphone and a bone-conducted sound pickup.

BACKGROUND OF THE INVENTION

Conventionally, this kind of transmitter-receiver employs, as its ear-piece or ear-set type acoustic transducing part, (1) means which picks up vibrations of the skull caused from talking sound by an acceleration pickup set in the auditory canal (which means will hereinafter be referred to also as a bone-conducted sound pickup microphone and the speech sending signal picked up by this means will hereinafter be referred to as a "bone-conducted sound signal"), or (2) means which guides a speech or talking sound as vibrations of air by a sound pickup tube extending to the vicinity of the mouth and picks up the sound by a microphone set on an ear (which means will hereinafter be referred to also as an air-conducted sound pickup microphone and the speech sending signal picked up by this means will hereinafter be referred to as an "air-conducted sound signal").

Such a conventional transmitter-receiver of the type which sends speech through utilization of bone conduction is advantageous in that it can be used even in a high-noise environment and permits hands-free communications. However, this transmitter-receiver is not suited to ordinary communications because of its disadvantages, i.e. the clarity of articulation of the transmitted speech is so low that the listener cannot easily identify the talker, the clarity of articulation of the transmitted speech greatly varies from person to person or according to the way of setting the acoustic transducing part on an ear, and an abnormal sound as by the friction of cords is also picked up. On the other hand, the transmitter-receiver of the type utilizing air conduction is more excellent in clarity than the above but has defects that it is inconvenient to handle when the sound pickup tube is long and the speech sending signal is readily affected by ambient noise when the tube is short.

The air-conducted sound pickup microphone picks up sounds that have propagated through the air, and hence has a feature that the tone quality of the picked-up speech signals is relatively good but is easily affected by ambient noise. The bone-conducted sound pickup microphone picks up a talker's vocal sound transmitted through the skull into the ear set, and hence has a feature that the tone quality of the picked-up speech signal is relatively low because of large attenuation of components above 1 to 2 KHz, but the speech signal is relatively free from the influence of ambient noise. As a transmitter-receiver assembly for sending excellent speech (acoustic) signals through utilization of the merits of such air-conducted sound pickup microphone and bone-conducted sound pickup microphone, there is disclosed in Japanese Utility Model Registration Application Laid-Open No. 206393/89 a device that mixes the speech signal picked up by the air-conducted sound pickup microphone and the speech signal picked up by the bone-conducted sound pickup microphone.

According to this device, the speech signals from the bone conduction type microphone and the air conduction type microphone are both applied to a low-pass filter and a high-pass filter which have a cutoff frequency of 1 to 2 KHz, then fed to variable attenuators and combined by a mixer into a speech sending signal. With this configuration, low-frequency noises in the output from the air conduction type microphone which are lower than the cutoff frequency are removed, and it is possible to remove or cancel components higher than the cutoff frequency in the noise which the bone conduction type microphone is likely to pick up, such as noise produced by friction between a cord extending from the ear set and the human body or clothing, or wind noise produced by wind blowing against the ear set. Moreover, in a high-noise environment, the SN ratio of the speech sending signal can be improved by decreasing the attenuation of the bone-conducted sound signal from the low-pass filter and increasing the attenuation of the air-conducted sound signal from the high-pass filter through manual control.

With this configuration, however, when the level of noise from the air-conducted sound pickup microphone is high, frequency components higher than the cutoff frequency need to be appreciably attenuated for the purpose of attenuating the noise, and consequently, the speech sending signal is substantially composed only of the bone-conducted sound signal components, and hence is extremely low in tone quality. Moreover, the attenuation control by the variable attenuator is manually effected by an ear set user and the user does not monitor the speech sending signal; hence, it is almost impossible to set the attenuation to the optimum value under circumstances where the amount of noise varies. Furthermore, it is cumbersome to manually control the ratio of combining the speech signal from the air-conducted sound pickup microphone and the speech signal from the bone-conducted sound pickup microphone.

SUMMARY OF THE INVENTION

It is therefore an object of the present invention to provide a transmitter-receiver which automatically processes the speech sending signal in accordance with use environments (such as the tone quality and the amount of sound) to send speech of the best tone quality.

The transmitter-receiver according to a first aspect of the present invention is constructed so that it comprises: an acoustic transducing part including a bone-conducted sound pickup microphone for picking up a bone-conducted sound and for outputting a bone-conducted sound signal, a directional microphone for picking up an air-conducted sound and for outputting an air-conducted sound signal, and a receiver for transducing a received speech signal to a received speech sound; a low-pass filter which permits the passage therethrough of those low-frequency components in the bone-conducted sound from the bone-conducted sound pickup microphone which are lower than a predetermined cutoff frequency; a high-pass filter which permits the passage therethrough of those high-frequency components in the air-conducted sound from the direction microphone which are higher than the above-mentioned cutoff frequency; first and second variable loss circuits which impart losses to the outputs from the low-pass filter and the high-pass filter, respectively; a comparison/control circuit which compares the output levels of the low-pass filter and the high-pass filter with predetermined first and second reference level values, respectively, and based on the results of comparison, controls the losses that are set in the first and second variable loss circuits; a combining circuit which combines the outputs from the first and second variable loss circuits into a speech sending signal; and means for supplying the received speech signal to the receiver.

The transmitter-receiver according to the first aspect of the invention may be constructed so that the acoustic transducing part includes an omnidirectional microphone for detecting a noise component, and the transmitter-receiver further comprises a noise suppressing part which suppresses the noise component by combining the outputs from the directional microphone and the omnidirectional microphone and supplies the high-pass filter with the combined output having canceled therefrom the noise component.

The transmitter-receiver according to a second aspect of the present invention is constructed so that it comprises: an acoustic transducing part including a bone-conducted sound pickup microphone for picking up a bone-conducted sound, a directional microphone for picking up an air-conducted sound, an ommidirectional microphone for detecting noise and a receiver for transducing a received speech signal to a received speech sound; a low-pass filter which permits the passage therethrough of those low-frequency components in the output from the bone-conducted sound pickup microphone which are lower than a predetermined cutoff frequency; a noise suppressing part which combines the outputs from the directional microphone and the omnidirectional microphone to suppress the noise component; a high-pass filter which permits the passage therethrough of those high-frequency components in the output from the noise suppressing part which are higher than the above-mentioned cutoff frequency; a combining circuit which combines the outputs from the low-pass filter and the high-pass filter into a speech sending signal; and means for supplying the received speech signal to the receiver.

The transmitter-receiver assembly according to the first or second aspect of the invention may be constructed so that it further comprise: third and fourth variable loss circuits connected to the output side of the combining circuit and the input side of the received speech signal supplying means, for controlling the levels of the speech sending signal and the received speech signal, respectively; and a second comparison/control circuit which compares the level of the speech sending signal to be fed to the third variable loss circuit and the level of the received speech signal to be fed to the fourth variable loss circuit with predetermined third and fourth reference level values, respectively, and based on the results of comparison, controls the losses that are set in the third and fourth variable loss circuits.

The transmitter-receiver according to a third aspect of the present invention is constructed so that it comprises: an acoustic transducing part including a bone-conducted sound pickup microphone for picking up a bone-conducted sound and for outputting a bone-conducted sound signal, an air-conducted sound pickup microphone for picking up an air-conducted sound and for outputting an air-conducted sound signal, and a receiver for transducing a received speech signal to a received speech sound; comparison/control means which estimates the level of ambient noise, compares the estimated ambient noise level with a predetermined threshold value and generates a control signal on the basis of the result of comparison; and speech sending signal generating means which responds to the control signal to mix the air-conducted sound signal from the air-conducted sound pickup microphone and the bone-conducted sound signal from the bone-conducted sound pickup microphone in accordance with the above-mentioned estimated noise level to generate a speech sending signal.

The transmitter-receiver according to the third aspect of the invention may be constructed so that the comparison/control means includes means for holding a relationship between the ambient noise level and at least the level of the air-conducted sound signal in non-talking states, and the comparison/control means obtains, as said estimated noise level, a noise level corresponding to the level of the air-conducted sound signal during the use of said transmitter-receiver based on said relationship, compares the estimated noise level with the above-mentioned threshold value, and generates the control signal on the basis of the result of comparison.

The transmitter-receiver according to the third aspect of the invention may also be constructed so that the comparison/control means includes means for holding a relationship between the ambient noise level and at least the level of the air-conducted sound signal in the talking state, and the comparison/control means obtains, as said estimated noise level, a noise level corresponding to the level of the air-conducted sound signal during the use of said transmitter-receiver based on said relationship, compares the estimated noise level with the threshold value, and generates the control signal on the basis of the result of comparison.

The transmitter-receiver according to the third aspect of the invention may also be constructed so that the comparison/control means includes means for holding a first relationship between the ambient noise level and at least the level of the air-conducted sound signal in the non-talking state and a second relationship between the ambient noise level and at least the level of the air-conducted sound signal in the talking state, and the comparison/control means compares the level of the received speech signal and at least one of the level of the air-conducted sound signal and the level of the bone-conducted sound signal during the use of the transmitter-receiver with predetermined first and second reference level values, respectively, to determine if the transmitter-receiver is in the talking or listening state, and based on the first or second relationship corresponding to the result of determination, obtains, as said estimated noise level, a noise level corresponding to at least the level of the air-conducted sound signal, then compares the estimated noise level with the threshold value, and generates the control signal on the basis of the result of comparison.

The transmitter-receiver according to the third aspect of the invention may also be constructed so that it further comprises first and second signal dividing means for dividing the air-conducted sound signal and the bone-conducted sound signal into pluralities of frequency bands, the speech sending signal generating means includes a plurality of signal mixing circuits each of which is supplied with the air-conducted sound signal and the bone-conducted sound signal of the corresponding frequency band from the first and second signal dividing means and mixes them in accordance with a band control signal, and a signal combining circuit which combines the outputs from the plurality of signal mixing circuits and outputs the combined signal as the speech sending signal, and the comparison/control means are supplied with the air-conducted sound signals of the corresponding frequency bands from at least the first signal dividing means, estimates the ambient noise levels of the respective frequency bands from at least the air-conducted sound signals of the corresponding frequency bands, then compares the estimated noise levels with a plurality of threshold values predetermined for the plurality of frequency bands, respectively, and generates the band control signals on the basis of the results of comparisons.

The transmitter-receiver according to the third aspect of the invention may also be constructed so that it further comprises a directional microphone and an omnidirectional microphone as the air-conducted sound pickup microphone means and noise suppressing means, and the noise suppressing means outputs the signal from the omnidirectional microphone as the air-conducted sound signal representing a noise signal during the silent and the listening state and, during the talking state, combines the signals from the directional microphone and the omnidirectional microphone and outputs the combined signal as the air-conducted sound signal with noise suppressed or canceled therefrom.

As described above, according to the first aspect of the present invention, a bone-conducted sound composed principally of low-frequency components and an air-conducted sound composed principally of high-frequency components are mixed together to generate the speech sending signal and the ratio of mixing the sounds is made variable in accordance with the severity of ambient noise or an abnormal sound picked up by the bone-conducted sound pickup microphone; therefore, it is possible to implement a transmitter-receiver which makes use of the advantages of the conventional bone-conduction communication device, i.e. it can be used in a high-noise environment and permits hands-free communications and which, at the same time, obviates the defects of the conventional bone-conduction communication device, such as low articulation or clarity of speech and discomfort by abnormal sounds.

According to the second aspect of the present invention, it is possible to efficiently cancel the noise component in the air-conducted sound by the noise component from the omnidirectionnal microphone and to effectively prevent howling which results from coupling the speech sending signal and the received speech signal.

According to the third aspect of the present invention, an estimated value of the ambient noise level is compared with a threshold value, then a control signal is generated on the basis of the result of comparison, and the air-conducted sound signal picked up by the directional microphone and the bone-conducted sound signal picked up by the bone-conducted sound pickup microphone are mixed together at a ratio specified by the control signal to generate the speech sending signal. Hence, this communication device is able to send a speech signal of excellent tone quality, precisely reflecting the severity and amount of ambient noise regardless of whether the device is in the talking or listening state.

BRIEF DESCRIPTION OF THE DRAWINGS

FIG. 1 is a sectional view illustrating the configuration of an acoustic transducing part for use in a first embodiment of the present invention;

FIG. 3 is a diagram for explaining the characteristics of a directional microphone and an omnidirectional microphone;

FIG. 4 is a table for explaining control operations of a comparison/control circuit 24 shown in FIG. 2;

DESCRIPTION OF THE PREFERRED EMBODIMENTS

Figure 2:
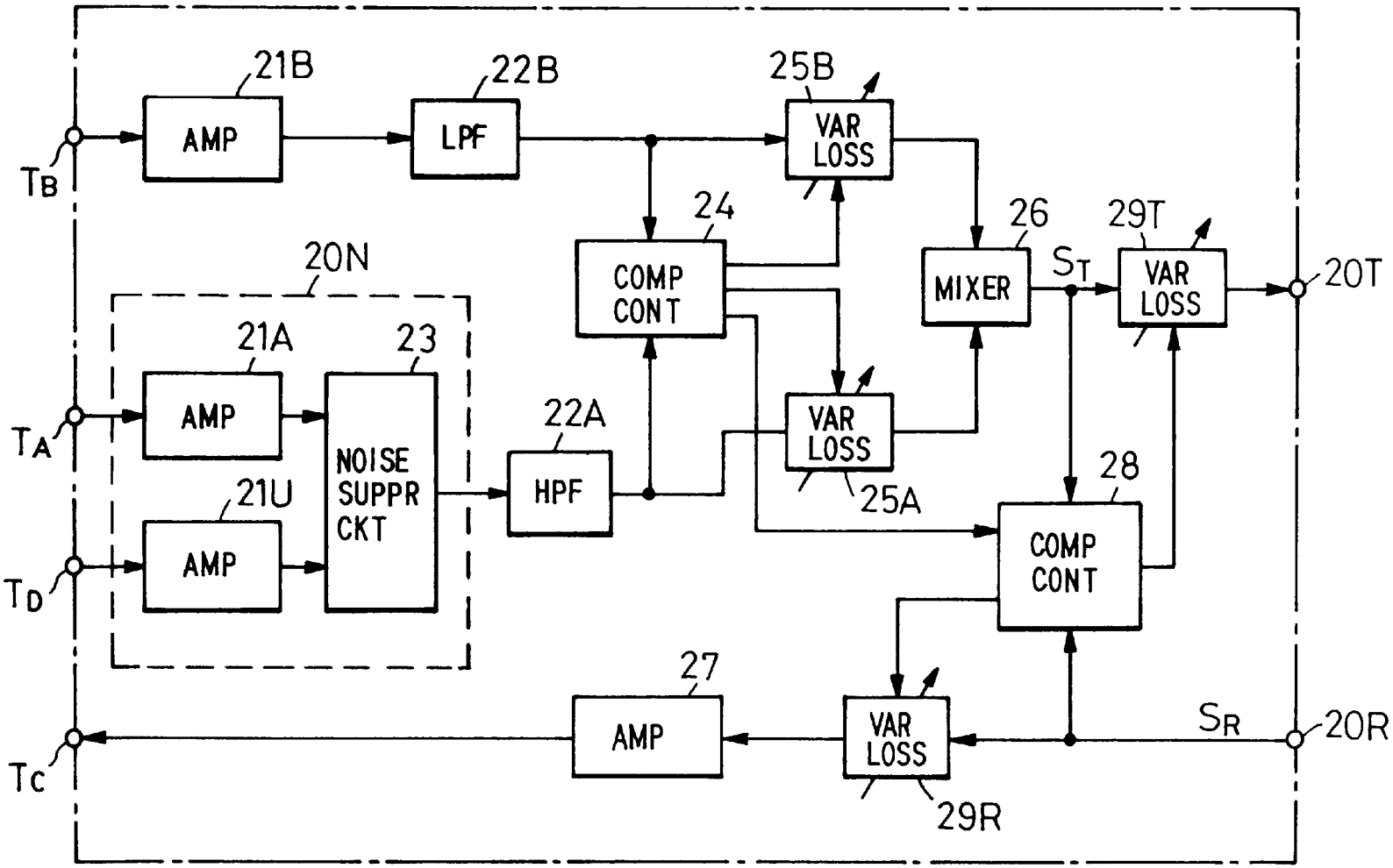
FIG. 2 is a block diagram illustrating the construction of a transmitting-receiving circuit connected to the acoustic transducing part in FIG. 1.

In FIG. 1 there is schematically illustrated the configuration of an ear-piece type acoustic transducing part 10 for use in an embodiment of the present invention. Reference numeral 11 denotes a case of the ear-piece type acoustic transducing part 10 wherein various acoustic transducers described later are housed, 12 is a lug or protrusion for insertion into the auditory canal 50, and 13 is a sound pickup tube for picking up air-conduction sounds. The sound pickup tube 13 is designed so that it faces the user's mouth when the lug 12 is put in the auditory canal 50; that is, it is adapted to pick up sounds only in a particular direction. The lug 12 and the sound pickup tube 13 are formed as a unitary structure with the case 11.

Reference numeral 14 denotes an acceleration pickup (hereinafter referred to as a bone-conduction sound microphone) for picking up bone-conduction sounds, and 15 is a directional microphone for picking up air-conduction sounds (i.e. an air-conduction sound microphone), which has such directional characteristics that its sensitivity is high in the direction of the user's mouth (i.e. in the direction of the sound pickup tube 13). The directional microphone 15 has its directivity defined by the combining of sound pressure levels of sound picked up from the front of the microphone 15 and sound picked up from behind through a guide hole 11H. Accordingly, the directivity could also be obtained even if the sound pickup tube 13 is removed to expose the front of the directional microphone 15 in the surface of the case 11.

Reference numeral 16 denotes an omnidirectional microphone for detecting noise, which has a sound pickup aperture or opening in the direction opposite to the directional microphone 15. Reference numeral 17 denotes an electro-acoustic transducer (hereinafter referred to as a receiver) for transducing a received speech signal into a sound, and 18 designates lead wires for interconnecting the acoustic transducing part 10 and a transmitting-receiving circuit 20 described later; the transmitting-receiving circuit 20 has its terminals $T_A$, $T_B$, $T_C$ and $T_D$ connected via the lead wires 18 to the directional microphone 15, the bone-conduction sound microphone 14, the receiver 17 and the omnidirectional microphone 16, respectively.

In FIG. 2 there is shown in block form the configuration of the transmitting-receiving circuit 20 which is connected to the acoustic transducing part 10 exemplified in FIG. 1. In FIG. 2 terminals $T_A$, $T_B$, $T_C$ and $T_D$ are connected to $T_A$, $T_B$, $T_C$ and $T_D$ in FIG. 1, respectively.

Reference numeral 21B denotes an amplifier for amplifying a bone-conduction sound signal from the bone-conduction sound microphone 14, and 21A is an amplifier for amplifying an air-conduction sound signal from the directional, air-conduction sound microphone 15. The gains of the amplifiers 21B and 21A are preset so that their output speech signal levels during a no-noise period are of about the same order at the inputs of a comparison/control circuit 24 described later. Reference numeral 21U denotes an amplifier which amplifies a noise signal from the noise detecting omnidirectional microphone 16 and whose gain is preset so that its noise output during a silent period becomes substantially the same as the noise output level of the amplifier 21A in a noise suppressor circuit 23 described later. The amplifiers 21A and 21B and the noise suppressor circuits 23 constitute a noise suppressing part 20N. The noise suppressor circuit 23 substantially cancels the noise signal by adding together the outputs from the amplifiers 21A and 21U after shifting them 180° out of phase to each other.

Reference numeral 22B denotes a low-pass filter (LPF), which may preferably be one that approximates characteristics inverse to the frequency characteristics of the bone-conduction sound microphone used; but it may be a simple low-pass filter of a characteristic such that it cuts the high-frequency components of the output signal from the amplifier 21B but passes therethrough the low-frequency components, and its cutoff frequency is selected within the range of 1 to 2 KHz. Reference numeral 22A denotes a high-pass filter (HPF), which may preferably be one that approximates characteristics inverse to the frequency characteristics of the directional microphone 15; but it may be a simple high-pass filter of a characteristic such that it cuts the low-frequency components of the output signal from the noise suppressor circuit 23 and passes therethrough the high-frequency components, and its cutoff frequency is selected within the range of 1 to 2 KHz.

The directional microphone 15 and the omnidirectional microphone 16 bear such a relationship of sensitivity characteristic that the former has a high sensitivity within a narrow azimuth angle but the sensitivity of the latter is substantially the same in all directions as indicated by ideal sensitivity characteristics 15S and 16S in FIG. 3, respectively. Then, assuming that the ambient noise level is the same in any directions and at any positions, and letting the total amount of noise energy per unit time applied to the omnidirectional microphone 16 from all directions be represented by the surface area $N_U$ of a sphere with a radius r, the noise energy per unit time applied to the directional microphone 15 is represented by an area $N_A$ defined by the spreading angle of its directional characteristic on the surface of the sphere. Hence, their energy ratio $N_A/N_U$ takes a value sufficiently smaller than one. Now, assume that the amounts of speech energy $S_A$ and $S_U$ applied to the directional microphone 15 and the omnidirectional microphone 16 take the same value S, and let the gains of the amplifiers 21A and 21U be represented by $G_A$ and $G_U$, respectively. By setting that a value $G_AN_A$ is nearly equal to a value $G_UN_U$, noise is substantially canceled by the noise suppressor circuit 23 but the speech signal level at the output of the noise suppressor circuit 23 becomes $G_AS-G_US=G_AS(1-N_A/N_U)$, and since the energy ratio $N_A/N_U$ is sufficiently smaller than one, the speech level is nearly equal to $G_AS$—this indicates that a speech signal in the air-conduction sound signal can be effectively extracted therefrom ideally. The noise suppressing effect that could be achieved by the directional microphone 15, the omnidirectional microphone 16 and the noise suppressing part 20N actually used was typically in the range of 3 to 10 dB.

In FIG. 2 the bone-conduction sound signal and the air-conduction sound signal, which have their frequency characteristics equalized by the low-pass filter 22B and the high-pass filter 22A, respectively, are applied to the comparison/control circuit 24, wherein their levels $V_B$ and $V_A$ are compared with predetermined reference levels $V_{RB}$ and $V_{RA}$, respectively. Based on the results of comparison, the comparison/control circuit 24 controls losses $L_B$ and $L_A$ of variable loss circuits 25B and 25A, thereby controlling the levels of the bone- and air-conducted sound signals. A mixer circuit 26 mixes the bone-conducted sound signal and the air-conducted sound signal which have passed through the variable loss circuits 25B and 25A. The thus mixed signal is provided as a speech sending signal $S_T$ to a speech sending signal output terminal 20T via a variable loss circuit 29T. A comparison/control circuit 28 compares the level of a speech receiving signal $S_R$ and the level of the speech sending signal $S_T$ with predetermined reference levels $V_{RR}$ and $V_{RT}$, respectively, and, based on the results of comparison, controls the losses of variable loss circuits 29T and 29R, thereby controlling the levels of the speech sending signal and the speech receiving signal to suppress an echo or howling. The speech receiving signal from the variable loss circuit 29R is amplified by an amplifier 27 to an appropriate level and then applied to the receiver 17 via the terminal $T_C$.

FIG. 4 is a table for explaining the control operations of the comparison/control circuit 24 in FIG. 2. The comparison/control circuit 24 compares the output level $V_B$ of the low-pass filter 22B and the output level $V_A$ of the high-pass filter 22A with the predetermined reference levels $V_{RB}$ and $V_{RA}$, respectively, and determines if the bone- and air-conducted sound signals are present (white circles) or absent (crosses), depending upon whether the output levels are higher or lower than the reference levels. In FIG. 4, state 1 indicates a state in which the bone-conducted sound signal (the output from the low-pass filter 23B) and the air-conducted sound signal (the output from the high-pass filter 23A), both frequency-equalized, are present at the same time, that is, a speech sending or talking state. State 2 indicates a state in which the bone-conducted sound signal is present but the air-conducted sound signal is absent, that is, a state in which the bone-conducted sound pickup microphone 14 is picking up abnormal sounds such as wind noise of the case 11 and frictional sounds produced by the lead wires 18 and the human body or clothing. State 3 indicates a state in which the air-conducted sound signal is present but the bone-conducted sound signal is absent, that is, a state in which no speech signal is being sent and that noise component of the ambient sound picked up by the directional microphone 15 which has not been canceled by the noise suppressor circuit 23 is being outputted. State 4 indicates a state in which neither of the bone- and air-conducted sound signals is present, that is, a state in which no speech signal is being sent and no noise is present. The control operations described in the right-hand columns of the FIG. 4 table show the operations which the comparison/control circuit 24 performs with respect to the variable loss circuits 25B and 25A in accordance with the above-mentioned states 1 to 4, respectively.

Next, a description will be given of the operation of an embodiment of the above construction. When a user of this transmitter-receiver utters a vocal sound with the ear-piece type acoustic transducing part 10 of FIG. 1 put on his or her ear, vibration of the skull as well as aerial vibration are created by the vibration of the vocal chords. The vibration of the skull is picked up as a bone-conducted sound signal by the bone-conducted sound pickup microphone 14, from 11 which the signal is provided via the terminal $T_B$ to the amplifier 21B. The aerial vibration of the speech is picked up by the directional microphone 15, from which the signal is provided as an air-conducted sound signal to the amplifier 21A via the terminal $T_A$.

In general, as compared with the air-conducted sound, the bone-conducted sound has many low-frequency components, makes less contribution to articulation and contains, in smaller quantity, high-frequency components which are important for the expression of consonants. On the other hand, abnormal sounds such as wind noise caused by the wind blowing against the case 11 and frictional sound between the cords (lead wires) 18 and the human body or clothing are present in lower and higher frequency bands than the cutoff frequencies of the filters 22A and 22B. Such wind noise and frictional sounds constitute contributing factors to the lack of articulation of the speech sending sound by the bone conduction and the formation of abnormal sounds. On the other hand, "speech" passes through the sound pickup tube 13 and is picked up as an air-conducted sound signal by the directional microphone 15, from which it is applied to the amplifier 21A via the terminal $T_A$. The air-conducted sound produced by a talker's speech is a human voice itself, and hence contains frequency components spanning low and high frequency bands.

In this embodiment, as described in the afore-mentioned Japanese Utility Model Registration Application Laid-Open Gazette, the high-frequency components of the bone-conducted sound from the amplifier 21B are removed by the low-pass filter 22B to extract the low-frequency components alone and the bone-conducted sound signal thus having cut out therefrom the high-frequency components is mixed with an air-conducted sound signal having cut out therefrom the low-frequency components by the high-pass filter 22A. By this, a speech sending signal is generated which has compensated for the degradation of the articulation which would be caused by the lack of the high-frequency components when the speech sending signal is composed only of the bone-conducted sound signal. Besides, according to the present invention, the processing for the generation of such a speech sending signal is automatically controlled to be optimal in accordance with each of the states shown in FIG. 4, by which it is possible to generate a speech sending signal of the best tone quality on the basis of time-varying ambient noise and the speech transmitting-receiving state.

The noise levels at the directional microphone 15 and the omnidirectional microphone 16 can be regarded as about the same level as referred to previously; but, because of a difference in their directional sensitivity characteristic, the directional microphone 15 picked up a smaller amount of noise energy than does the omnidirectional microphone 16, and hence provides a higher SN ratio. Since the gains $G_A$ and $G_U$ of the amplifiers 21A and 21U are predetermined so that their output noise levels become nearly equal to each other as mentioned previously, the gain $G_A$ of the amplifier 21A is kept sufficiently larger than the gain $G_U$ of the amplifier 21U. Hence, the user's speech signal is amplified by the amplifier 21A with the large gain $G_A$ and takes a level higher than the noise signal level.

The comparison/control circuit 24 compares, at regular time intervals (1 sec, for instance), the outputs from the low-pass filter 22B (for the bone-conducted sound) and the high-pass filter 22A (for the air-conducted sound) with the reference levels $V_{RB}$ and $V_{RA}$, respectively, to perform such control operations as shown in FIG. 4. At first, the characteristic of the transmitter-receiver of the present invention immediately after its assembling is adjusted (or initialized) by setting the losses $L_B$ and $L_A$ of the variable loss circuits 25B and 25A to initial values $L_{B0}$ and $L_{A0}$ that the level of the air-conducted sound signal to be input into the mixer 26 is higher than the level of the bone-conducted sound signal by 3 to 10 dB when no noise is present (State 4 in FIG. 4). The reason for this is that it is preferable in terms of articulation that the air-conducted sound be larger than the air-conducted one under circumstances where no noise is present.

Next, a description will be given of the actual state of use in which the levels of the bone- and air-conducted sound signals vary every moment.

(a) When the output (the bone-conducted sound signal) from the low-pass filter 22B is not present (State 3 or 4 in FIG. 4):

The comparison/control circuit 23 compares the output level $V_A$ of the high-pass filter 22A with the reference level $V_{RA}$. When the output from the high-pass filter 22A is smaller than the reference level $V_{RA}$ (State 4), the comparison/control circuit 23 decides that noise is not present or small and that no talks are being carried out and sets the losses of the variable loss circuits 25B and 25A to the afore-mentioned initial values $L_{B0}$ and $L_{A0}$, respectively. When this state changes to the talking state (State 1), a mixture of the bone-conducted sound signal composed of low-frequency components and the air-conducted sound signal composed of high-frequency components is provided as the speech sending signal $S_T$ at the output of the mixer circuit 26.

Next, when the output level $V_B$ of the low-pass filter 22B is smaller than the reference level $V_{RB}$ and the output level $V_A$ of the high-pass filter 22A is larger than the reference level $V_{RA}$ (State 3), the comparison/control circuit 23 decides that no talks are being carried out and that ambient noise is large. In this instance, the comparison/control circuit 23 applies a control signal $C_A$ to the variable loss circuit 25A to set its loss $L_A$ to a value larger than the initial value $L_{A0}$ in proportion to the difference between the output level $V_A$ of the high-pass filter 22A and the reference level value $V_{RA}$ as expressed by such an equation as follows:

$$L_A=K(V_A-V_{RA})+L_{A0} \tag{1}$$

where K is a predetermined constant. Alternatively, it is possible to increase the loss $L_A$ by a constant K on a stepwise basis each time the level difference $(V_A-V_{RA})$ increases by a constant $V_M$, as expressed by the following equation:

$$L_A=[(V_A-V_{RA})/V_M]K+L_{A0} \tag{2}$$

where [X] represents the smallest integer greater than x.

When the output from the low-pass filter 22B becomes larger than the reference level $V_{RB}$, that is, when this State 3 changes to the talking state (State 1), the losses of the variable loss circuits 25A and 25B are not changed but are kept at set values in the immediately preceding State 3. By this, the bone-conducted sound signal composed of low-frequency components and the air-conducted sound signal of the same level as or lower than the level of the bone-conducted sound signal and composed of high-frequency components are mixed by the mixer circuit 26 into the speech sending signal $S_T$. In this case, it is also possible to hold the loss of the variable loss circuit 25A unchanged and control the loss of the variable loss circuit 25B so that the mixed output level of the mixer circuit 26 takes a predetermined value.

(b) When the output (the bone-conducted sound signal) level $V_B$ of the low-pass filter 22B is larger than the reference level $V_{RB}$ (State 1 or 2 in FIG. 4):

The comparison/control circuit 24 checks the output level $V_A$ of the high-pass filter 22A and, if it is smaller than the reference level $V_{RA}$ (State 2), determines that no talks are being carried out and that the bone-conducted sound pickup microphone 14 is picking up abnormal sounds. In such an instance, the comparison/control circuit 24 applies a control signal $C_B$ to the variable loss circuit 25B to set its loss $L_B$ to a value greater than the initial value $L_{B0}$ in proportion to the difference between the output level $V_B$ of the low-pass filter 22B and the reference level $V_{RA}$, as expressed by the following equation:

$$L_B=K(V_B-V_{RB})+L_{B0} \tag{3}$$

Alternatively, as is the case with the above, the loss $L_B$ may be controlled as expressed by the following equation:

$$L_B=[(V_B-V_{RB})/V_M]K+L_{B0} \tag{4}$$

When the output level $V_A$ of the high-pass filter 22A becomes larger than the reference level $V_{RA}$, that is, when this State 2 changes to the talking state (State 1), the losses of the variable loss circuits 25A and 25B are held unchanged, and hence are kept at the set values in the immediately preceding State 2. An air-conducted sound signal composed of high-frequency components and a bone-conducted sound signal of a level set in accordance with the output level $V_B$ of the low-pass filter 22B and composed of low-frequency components are mixed together by the mixer circuit 26. In this instance, it is also possible to hold the loss of the variable loss circuit 25B unchanged and control the loss of the variable loss circuit 25A so that the output level of the mixer circuit 26 may assume the aforementioned predetermined fixed value.

Next, when the output level $V_A$ of the high-pass filter 22*a* is larger than the reference level $V_{RA}$ (State 1), the comparison/control circuit 24 decides that the state is the talking state, and causes the variable loss circuits 25B and 25A to hold losses set in the state immediately preceding State 1. As a result, bone- and air-conducted sound signals of levels controlled in accordance with the losses held unchanged are mixed by the mixer circuit 26, which provides the speech sending signal $S_T$.

Incidentally, the variable loss circuits 29T and 29R and the comparison/control circuit 28 are provided to suppress the generation of an echo and howling which result from the coupling of the speech sending system and the speech receiving system. The ear-piece type acoustic transducing part 10 has the following two primary contributing factors to the coupling which leads to the generation of howling. First, when the transmitter-receiver assembly is applied to a telephone set, a two-wire/four-wire junction at a telephone station allows the speech sending signal to sneak as an electrical echo into the speech receiving system from the two-wire/four-wire junction, providing the coupling (sidetone) between the two system. Second, a speech receiving signal is picked up by the bone-conducted sound pickup microphone 14 or directional microphone 15 as a mechanical vibration from the receiver 17 via the case 11—this also provides the coupling between the two systems. Such phenomena also occur in a loudspeaking telephone system which allows its user to communicate through a microphone and a loudspeaker without the need of holding a handset. In this instance, however, the cause of the sneaking of the received sound into the speech sending system is not the mechanical vibration but the acoustic coupling between the microphone and the speaker through the air.

This problem could be solved by known techniques such as a method for the suppression of howling in the loudspeaking telephone system. The configuration by the comparison/control circuit 28 and the variable loss circuits 29T and 29R is an example of such a prior art. The comparison/control circuit 28 monitors the output level $V_T$ of the mixer circuit 26 and the signal level $V_R$ at a received speech input terminal 20R and, when the speech receiving signal level $V_R$ is larger than a predetermined level $V_{RR}$ and the output level $V_T$ of the mixer circuit 26 is smaller than a predetermined level $V_{RT}$, the circuit 28 decides that the transmitter-receiver is in the speech receiving state, and sets a predetermined loss $L_T$ in the variable loss circuit 29T, reducing the coupling of the speech receiving signal to the speech sending system. When the output level $V_T$ of the mixer circuit 26 is larger than the predetermined level $V_{RT}$ and the input level $V_R$ at the speech receiving signal input terminal 20R is lower than the predetermined level $V_{RR}$, the comparison/control circuit 28 decides that the transmitter-receiver is in the talking state, and sets a predetermined loss $L_R$ in the variable loss circuit 29R, suppressing the sidetone from the speech receiving system. When the output level $V_T$ of the mixer circuit 26 and the input level $V_R$ at the speech receiving signal input terminal 20R are higher than the predetermined levels $V_{RT}$ and $V_{RR}$, respectively, the comparison/control circuit 28 decides that the transmitter-receiver is in a double-talk state, and sets in the variable loss circuits 29T and 29R losses one-half those of the above-mentioned predetermined values $L_T$ and $L_R$, respectively. In this way, speech with great clarity can be sent to the other party in accordance with the severity of ambient noise and the presence or absence of abnormal noise.

According to the first embodiment described above, a mixture of the bone-conducted sound signal composed principally of low-frequency components and the air-conducted sound signal composed principally of high-frequency components is used as the speech signal that is sent to the other party. Moreover, the ratio of mixture of the two signals is automatically varied with the magnitude of ambient noise and the abnormal sound picked up by the bone-conducted sound pickup microphone. This permits the implementation of a transmitter-receiver which can be used in a high-noise environment, obviates such defects of the prior art as low clarity or articulation and discomfort by abnormal sound, and allows hands-free communications.

In the embodiment depicted in FIGS. 1 and 2, the comparison/control circuit 24 and the variable loss circuits 25A and 25B may be dispensed with, and even in such a case, the noise level can be appreciably suppressed by the operations of the directional microphone 15, the omnidirectional microphone 14 and the amplifiers 21A and 21B and the noise suppressing circuit 23 which form the noise suppressing part 20N; hence, it is possible to obtain a transmitter-receiver of higher speech quality than in the past. Alternatively, the omnidirectional microphone 16, the amplifier 21U and the noise suppressing circuit 23 may be omitted, and in this case, too, the processing for the generation of the optimum speech sending signal can automatically be performed by the operations of the comparison/control circuit 24, the variable loss circuits 25A and 25B and the mixer circuits 26 in accordance with the states of signals involved.

Next, a detailed description will be given, with reference to FIGS. 5 through 9, of a second embodiment of the transmitter-receiver according to the present invention.

Figure 5:
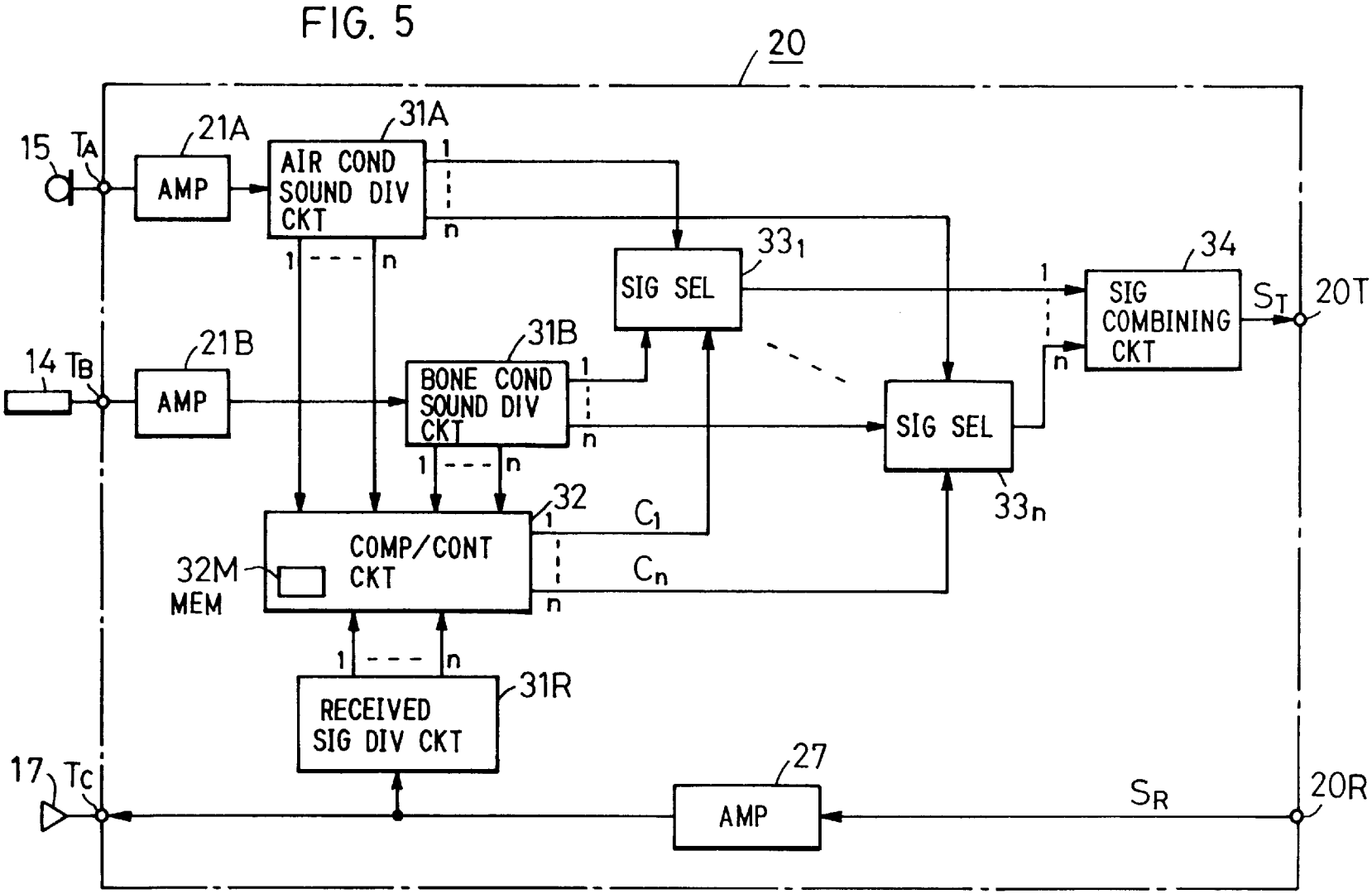
FIG. 5 is a block diagram illustrating a transmitter-receiver according to a second embodiment of the present invention.

FIG. 5 illustrates in block form the transmitter-receiver according to the second embodiment of the invention. The bone-conducted sound pickup microphone 14, the directional microphone 15 and the receiver 17 are provided in such an ear-piece type acoustic transducing part 10 as depicted in FIG. 1. In this embodiment, the air-conducted sound signal from the directional microphone (the air-conducted sound pickup microphone 15) and the bone-conducted sound signal from the bone-conducted sound pickup microphone 14 are fed to an air-conducted sound dividing circuit 31A and a bone-conducted sound dividing circuit 31B via the amplifiers 21A and 21B of the transmitting-receiving circuit 20, respectively. As is the case with FIG. 2, the gains of the amplifiers 21A and 21B are preset so that input air-and bone-conducted sound signals of a vocal sound uttered in a no-noise environment have about the same level. The air-conducted sound dividing circuit 31A divides the air-conducted sound signal from the directional microphone 15 into first through n-th frequency bands and applies the divided signals to a comparison/control circuit 32 and signal select circuits $\mathbf{33}_1$ through $\mathbf{33}_n$. The bone-conducted sound dividing circuit 31B divides the bone-conducted sound signal from the bone-conducted sound pickup microphone 14 into first through n-th frequency bands and applies the divided signals to the comparison/control circuit 32 and the signal select circuits $\mathbf{33}_1$ through $\mathbf{33}_n$. In the present invention, the air- and bone-conducted sound signals need not always be divided (i.e. n=1), but when divided into frequency bands, they are divided, for example, every one or one-third octave, or into high and low bands, or high, intermediate and low bands.

A received signal dividing circuit 31R divides the received signal $S_R$ from an external line circuit via the input terminal 20R into first through n-th frequency bands and applies the divided signal to the comparison/control circuit 32. In this embodiment, the comparison/control circuit 32 is such one that converts each input signal into a digital signal by an A/D converter (not shown), and performs such comparison and control operations by a CPU (not shown) as described below. That is, the comparison/control circuit 32 calculates an estimated value of the ambient noise level for each frequency band on the basis of the air-conducted sound signals of the respective bands from the air-conducted sound dividing circuit 31A, the bone-conducted sound signals of the respective bands from the bone-conducted sound dividing circuit 31B and the received signals of the respective bands from the received signal dividing circuit 31R. The comparison/control circuit 32 compares the estimated values of the ambient noise levels with a predetermined threshold value (i.e. a reference value for selection) $N_{th}$ and generates control signals $C_1$ to $C_n$ for the respective bands on the basis of the results of comparison. The control signals $C_1$ to $C_n$ thus produced are applied to the signal select circuits $\mathbf{33}_1$ to $\mathbf{33}_n$, respectively. The signal select circuits $\mathbf{33}_1$ to $\mathbf{33}_n$ respond to the control signals $C_1$ to $C_n$ to select the air-conducted sound signals input from the air-conducted sound dividing circuit 31A or the bone-conducted sound signals from the bone-conducted sound signal dividing circuit 31B, which are provided to a signal combining circuit 34. The signal combining circuit 34 combines the input speech signals of the respective frequency bands, taking into account the balance between the respective frequency bands, and provides the combined signal to the speech transmitting output terminal 20T. The output terminal 20T is a terminal which is connected to an external line circuit.

Figure 6:
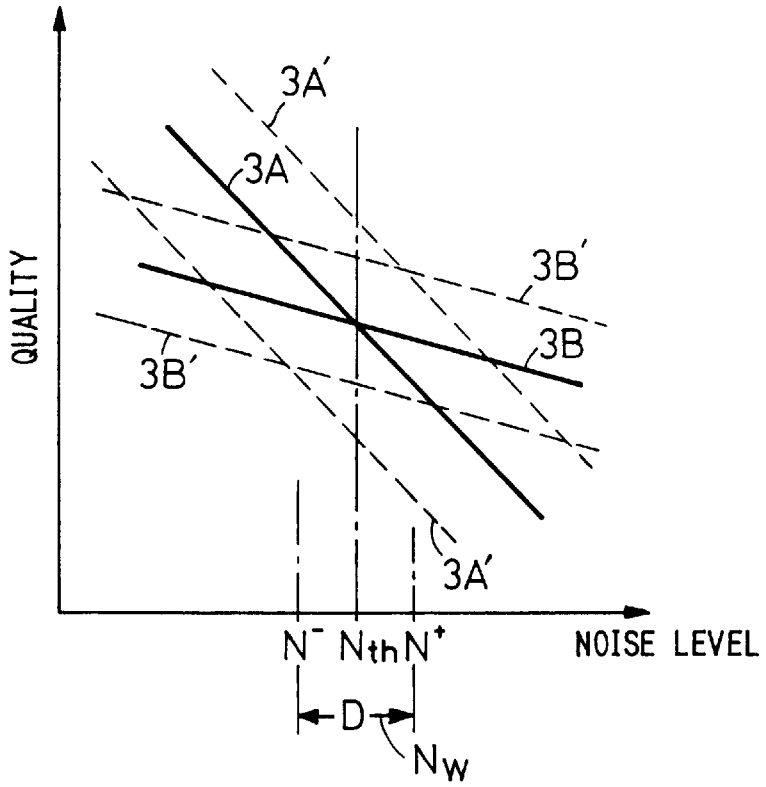
FIG. 6 is a graph showing the relationship between the tone quality of an air-conducted sound signal and the ambient noise level, and the relationship between the tone quality of a bone-conducted sound signal and the ambient noise level.

FIG. 6 is a graph showing, by the solid lines 3A and 3B, a standard or normal relationship between the tone quality (evaluated in terms of the SN ratio or subjective evaluation) of the air-conducted sound signal picked up by the directional microphone 15 and the ambient noise level and a standard or normal relationship between the tone quality of the bone-conducted sound signal picked up by the bone-conducted sound pickup microphone and the ambient noise level. The ordinate represents the tone quality of the sound signals (the SN ratio in the circuit, for instance) and the abscissa the noise level. As indicated by the solid line 3A, the tone quality of the air-conducted sound signal picked up by the directional microphone 15 is greatly affected by the ambient noise level; the tone quality is seriously degraded when the ambient noise level is high. On the other hand, as indicated by the solid line 3B, the tone quality of the bone-conducted sound signal picked up by the bone-conducted sound pickup microphone 14 is relatively free from the influence of the ambient noise level; degradation of the tone quality by the high noise level is relatively small. Hence, the speech sending signal $S_T$ of good tone quality can be generated by setting the noise level at the intersection of the two solid lines 3A and 3B as the threshold value $N_{th}$ and by selecting either one of the air-conducted sound signal picked up by the directional microphone 15 and the bone-conducted sound signal picked up by the bone-conducted sound pickup microphone, depending upon whether the ambient noise level is higher or lower than the threshold value $N_{th}$. It was experimentally found that the threshold value $N_{th}$ is substantially in the range of 60 to 80 dBA. The characteristics indicated by the solid lines 3A and 3B in FIG. 6 are standard; the characteristics vary within the ranges defined by the broken lines 3A' and 3B' in dependence upon the characteristics of the microphones 14 and 15, the preset gains of the amplifiers 21A and 21B and the frequency characteristics of the input speech signals, but they remain in parallel to the solid lines 3A and 3B, respectively. The solid lines 3A and 3B are substantially straight.

The relationship between the tone quality of the air-conducted sound signal by the directional microphone 15 and the ambient noise level and the relationship between the tone quality of the bone-conducted sound signal by the bone-conducted sound pickup microphone 14 and the ambient noise level differ with the respective frequency bands. For this reason, according to this embodiment, the sound signals are each divided into respective frequency bands and either one of the air- and bone-conducted sound signals is selected depending upon whether the measured ambient noise level is higher or lower than a threshold value set for each frequency band—this provides improved tone quality of the speech sending signal.

Figure 7:
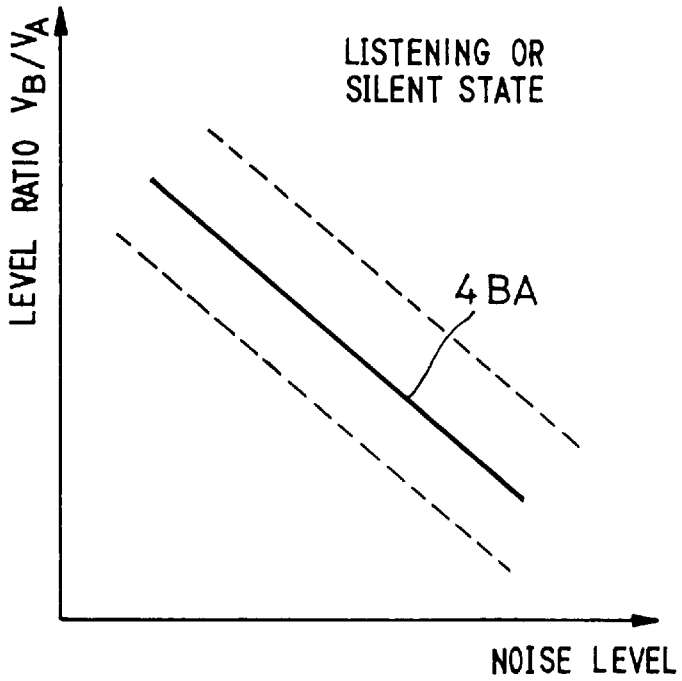
FIG. 7 is a graph showing the relationship of the ambient noise level to the level ratio between the bone-conducted sound signal and the air-conducted sound signal in the listening or silent state.
Figures 8, 9:
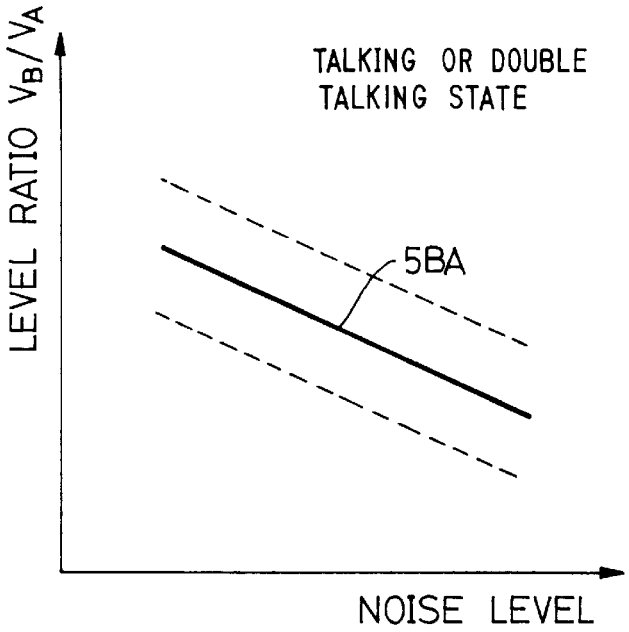
FIG. 8 is a graph showing the relationship of the ambient noise level to the level ratio between the bone-conducted sound signal and the air-conducted sound signal in the talking or double-talking state.
FIG. 9 is a table for explaining operating states of the FIG. 5 embodiment.

To switch between the air- and bone-conducted sound signals in accordance with the ambient noise level, it is necessary to calculate an estimated value of the ambient noise level. FIG. 7 is a graph showing, by the solid line 4BA, a standard relationship of the ambient noise level (on the abscissa) to the level ratio (on the ordinate) between an ambient noise signal picked up by the directional microphone 15 and an ambient noise signal picked-up by the bone-conducted sound pickup microphone 14 in the listening or speech receiving or silent states. FIG. 8 is a graph showing, by the solid line 5BA, a standard relationship of the ambient noise level to the level ratio between a signal (the air-conducted sound signal plus the ambient noise signal) picked up by the directional microphone 15 and a signal (the bone-conducted sound signal plus the ambient noise signal) picked-up by the bone-conducted sound pickup microphone 15 in the talking or double-talking state. As shown in FIGS. 7 and 8, the characteristic in the listening or silent state and the characteristic in the talking or double-talking state differ from each other. Hence, the level $V_A$ of the air-conducted sound signal from the directional microphone 15, the level $V_B$ of the bone-conducted sound signal from the bone-conducted sound pickup microphone 15 and the level $V_R$ of the received signal from the amplifier 27 are compared with the reference level values $V_{RA}$, $V_{RB}$ and $V_{RR}$, respectively, to determine if the transmitter-receiver is in the listening (or silent) state or in the talking (or double-talking) state. Next, the level ratio $V_B/V_A$ between the bone-conducted sound signal and the air-conducted sound signals picked up by the microphones 14 and 15 in the listening or silent state is calculated, and the noise level at that time is estimated from the level ratio through utilization of the straight line 4BA in FIG. 7. Depending upon whether the estimated noise level is higher or lower than the threshold value $N_{th}$ in FIG. 6, the signal select circuits $\mathbf{33}_1$ to $\mathbf{33}_n$ each select the bone-conducted sound signal or air-conducted sound signal. Similarly, the level ratio $V_B/V_A$ between the bone-conducted sound signal and the air-conducted sound signal in the talking or double-talking state is calculated, then the noise level at that time is estimated from the straight line 5BA in FIG. 8, and the bone-conducted sound signal or air-conducted sound signal is similarly selected depending upon whether the estimated noise level is above or below the threshold value $N_{th}$.

Next, the operation of the transmitter-receiver will be described. Incidentally, let is be assumed that there are prestored in a memory 32M of the comparison/control circuit 32 the reference level values $V_{RA}$, $V_{RB}$ and $V_{RR}$, the threshold value $N_{th}$ and the level ratio vs. noise level relationships shown in FIGS. 7 and 8. Since the speech signals and the received signals divided into the first through n-th frequency bands are subjected to exactly the same processing until they are input into the signal combining circuit 34, the processing in only one frequency band will be described using reference numerals with no suffixes indicating the band.

The comparison/control circuit 32 compares, at regular time intervals (of one second, for example), the levels $V_A$, $V_B$ and $V_R$ of the air-conducted sound signal, the bone-conducted sound signal and the received signal input from the air-conducted sound dividing circuit 31A, the bone-conducted sound dividing circuit 31B and the received signal dividing circuit 31R with the predetermined reference level values $V_{RA}$, $V_{RB}$ and $V_{RR}$, respectively. When the level $V_R$ of the received signal $S_R$ is higher than the predetermined value $V_{RR}$ and the level $V_A$ of the air-conducted sound signal picked up by the directional microphone 15 and the level $V_B$ of the bone-conducted sound signal picked up by the bone-conducted sound pickup microphone 14 are smaller than the predetermined values $V_{RA}$ and $V_{RB}$, respectively, the comparison/control circuit 32 determines that this state is the listening state shown in the table of FIG. 9. When the level $V_R$ of the received signal level $V_R$ is smaller than the predetermined value $V_{RR}$ and the levels $V_A$ and $V_B$ of the air-conducted sound signal and the bone-conducted sound signal are both smaller than the predetermined values $V_{RA}$ and $V_{RB}$, the circuit 32 determines that this state is the silent state. In these two states the comparison/control circuit 32 calculates the level ratio $V_B/V_A$ between the air-conducted sound signal from the air-conducted sound dividing circuit 31A and the bone-conducted sound signal from the bone-conducted sound dividing circuit 31B. Based on the value of this level ratio, the comparison/control circuit 32 refers to the relationship of FIG. 7 stored in the memory 32M to obtain an estimated value of the corresponding ambient noise level. When the estimated value of the ambient noise level is smaller than the threshold value $N_{th}$ shown in FIG. 6, the comparison/control circuit 32 supplies the signal select circuit 33 with a control signal C instructing it to select and output the air-conducted sound signal input from the air-conducted sound dividing circuit 31A. When the estimated value of the ambient noise level is greater than the threshold value $N_{th}$, the comparison/control circuit 32 applied the control signal C to the signal select circuit 33 to instruct it to select and output the bone-conducted sound signal input from the bone-conducted sound dividing circuit 31B.

On the other hand, when the received signal level $V_R$ is smaller than the reference level value $V_{RR}$ and the levels $V_A$ and $V_B$ of the air-conducted sound signal by the directional microphone 15 and the bone-conducted sound signal by the bone-conducted sound pickup microphone 14 are larger then the predetermined reference level values $V_{RA}$ and $V_{RB}$, the comparison/control circuit 32 determines that this state is the talking state shown in the table of FIG. 9. When the received signal level $V_R$ is larger than the reference level value $V_{RR}$ and the levels $V_A$ and $V_B$ of the air-conducted sound signal and the bone-conducted sound signal are larger than the predetermined reference level values $V_{RA}$ and $V_{RB}$, the comparison/control circuit 32 determines that this state is the double-talking state. In these two states the comparison/control circuit 32 calculates the level ratio $V_B/V_A$ between the bone-conducted sound signal and the air-conducted sound signal and estimates the ambient noise level N through utilization of the relationship of FIG. 8 stored in the memory 32M.

When the thus estimated value of the ambient noise level N is smaller than the threshold value $N_{th}$ shown in FIG. 6, the comparison/control circuit 32 applies the control signal C to the signal select circuit 33 to cause it to select and output the air-conducted sound signal input from the air-conducted sound dividing circuit 31A. When the estimated value N of the ambient noise level is greater than the threshold value $N_{th}$, the circuit 32 applies the control signal C to the signal select circuit 33 to cause it to select and output the bone-conducted sound signal input from the bone-conducted sound dividing circuit 31B.

The comparison/control circuit 32 has, in the memory 32M for each of the first through n-th frequency bands, the predetermined threshold value $N_{th}$ shown in FIG. 6 and the level ratio vs. noise level relationships representing the straight characteristic lines 4BA and 5BA shown in FIGS. 7 and 8. The comparison/control circuit 32 performs the same processing as mentioned above and applies the resulting control signals $C_1$ to $C_n$ to the signal select circuits $\mathbf{33}_1$ to $\mathbf{33}_n$. The signal combining circuit 34 combines the speech signals from the signal select circuits $\mathbf{33}_1$ to $\mathbf{33}_n$, taking into account the balance between the respective frequency bands.

While in the above the embodiments have been described to estimate and compare the noise level with the threshold value and control the signal select circuits $\mathbf{33}_1$ to $\mathbf{33}_n$ accordingly in any state described in the table of FIG. 9, it is also possible to employ a scheme that estimates the noise level only in the silent or listening state and uses the thus estimated noise level to effect control in the talking state and the double-taking state. In such an instance, the characteristic data of FIG. 8 need not be stored in the memory 32M. In contrast to this, the estimation of the noise level may be made only in the talking or double-talking state, in which case the estimated noise level is used for control in the talking or double-talking state. In this instance, the characteristic data of FIG. 7 is not needed.

Incidentally, the double-talking state duration and the silent state duration are shorter than the talking or listening state duration. Advantage may also be taken of this to effect control in the double-talking state and in the silent state by use of the ambient noise level estimated prior to these states.

When the level of the bone-conducted sound signal picked up by the bone-conducted sound pickup microphone 14 is abnormally high, it can be considered that the signal includes noise made by the friction of cords or the like; hence, it is effective to select the air-conducted sound signal picked up by the directional microphone 15.

In the case where the estimated noise level N is compared with the threshold value $N_{th}$ for each frequency band and the air-conducted sound signal picked up by the directional microphone 15 is switched to the bone-conducted sound signal by the bone-conducted sound pickup microphone 14 on the basis of the result of comparison as described previously with reference to the FIG. 5 embodiment, the timbre of the speech being sent may sometimes undergo an abrupt change, making the speech unnatural. To solve this problem, an area $N_W$ of a fixed width as indicated by $N^-$ and $N^+$ is provided about the threshold value $N_{th}$ of the ambient noise level shown in FIG. 6; when the estimated noise level N is within the area $N_W$, the air-conducted sound signal from the directional microphone 15 and the bone-conducted sound signal from the bone-conducted sound pickup microphone 14 are mixed in a ratio corresponding to the noise level, and when the estimated noise level N is larger than the area $N_W$, the bone-conducted sound signal is selected, and when the estimated noise level is smaller than the area $N_W$, the air-conducted sound signal is selected. By this, it is possible to reduce the abrupt change in the timbre prior to or subsequent to the switching operation.

Figure 10A:
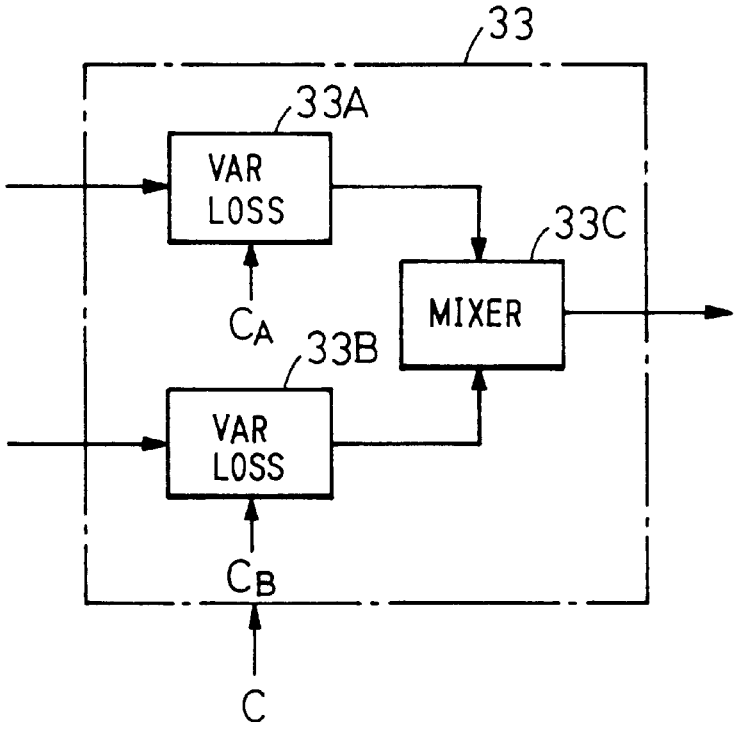
FIG. 10A is a block diagram showing the construction of a signal mixing circuit which is used as a substitute for each of signal select circuits $\mathbf{33}_1$ to $\mathbf{33}_n$ in the FIG. 5 embodiment.

The modification of the FIG. 5 embodiment for such signal processing can be effected by using, for example, a signal mixer circuit 33 depicted in FIG. 10A in place of each of the signal select circuits $\mathbf{33}_1$ to $\mathbf{33}_n$. In this example, the corresponding air-conducted sound signal and bone-conducted sound signal of each frequency band are applied to variable loss circuits 33A and 33B, respectively, wherein they are given losses $L_A$ and $L_B$ set by control signals $C_A$ and $C_B$ from the comparison/control circuit 32. The two signals are mixed in a mixer 33C and the mixed signal is applied to the signal combining circuit 34 in FIG. 5.

Figure 10B:
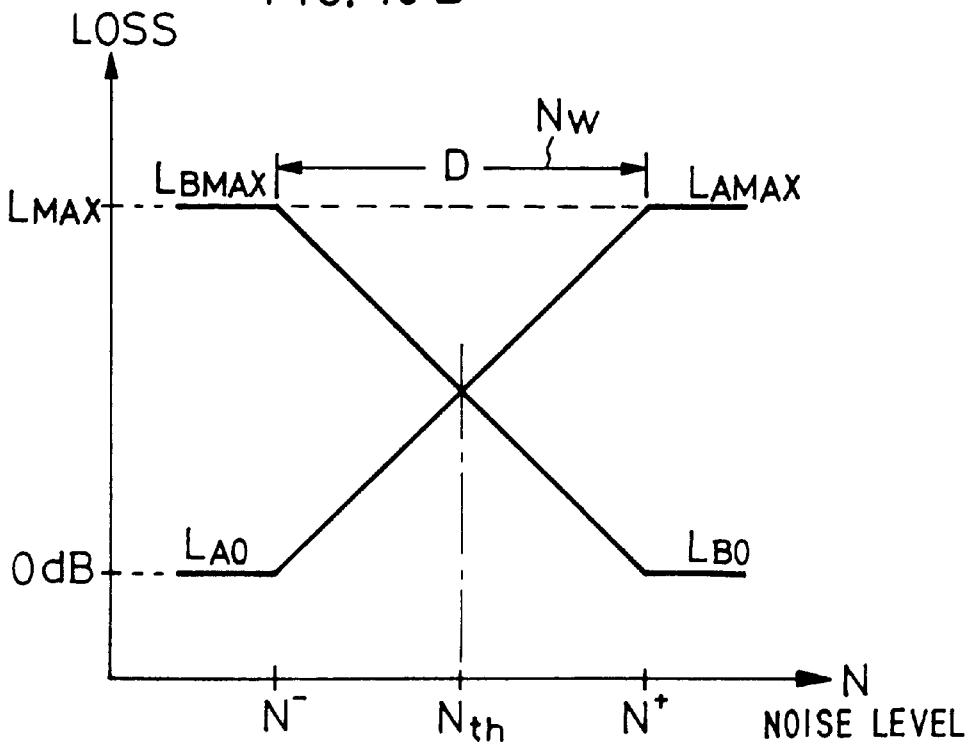
FIG. 10B is a graph showing the mixing operation of the circuit shown in FIG. 10A.

The losses $L_A$ and $L_B$ for the air-conducted sound signal and the bone-conducted sound signal in the area $N_W$ need only be determined as shown in FIG. 10B, for instance. For brevity's sake, setting $N_{th}=(N^++N^-)/2$, the area width to $D=N^+-N^-$, the minimum values $L_{A0}$ and $L_{B0}$ of the losses $L_A$ and $L_B$ to 0 dB, respectively, and their maximum values $L_{AMAX}$ and $L_{BMAX}$ to the same $L_{MAX}$ dB, the loss $L_A$ in the area $N_W$ can be expressed, for example, by the following equation:

$$L_A = \frac{1}{2}(L_{AMAX} - L_{A0}) + \frac{L_{AMAX} - L_{A0}}{N^+ - N^-}(N + N_{th}) + L_{A0} = L_{MAX}\left\{\frac{1}{2} - \frac{N - N_{th}}{D}\right\} \quad (5)$$

Similarly, the loss $L_B$ can be expressed by the following equation:

$$L_B = L_{MAX}\left\{\frac{1}{2} - \frac{N - N_{th}}{D}\right\} \quad (6)$$

The value of the maximum loss $L_{MAX}$ is selected in the range of between 20 and 40 dB, and the width D of the area $N_W$ is set to about 20 dB, for instance. When the estimated noise level N is larger than the area $N_W$, the bone-conducted sound signal is not given any loss ($L_B$=0) and is applied intact to the mixer 33C. On the other hand, the air-conducted sound signal is not given the loss $L_{MAX}$ but instead the variable loss circuit 33A is opened to cut off the signal. Similarly, when the estimated noise level N is smaller than the area $N_W$, the air-conducted sound signal is not given any loss ($L_A$=0) and is fed intact to the mixer 33C, whereas the bone-conducted sound signal is cut off by opening the variable loss circuit 33B. The comparison/control circuit 32 determines the losses $L_A$ and $L_B$ for each band as described and sets the losses in the variable loss circuits 33A and 33B by the control signals $C_A$ and $C_B$.

With such signal processing as described above, it is possible to provide smooth timbre variations of the speech being sent when the air-conducted sound signal is switched to the bone-conducted sound signal or vice versa. Moreover, if the levels of the air-conducted sound signal and the bone-conducted sound signal input into the variable loss circuits 33A and 33B are nearly equal to each other, the output level of the mixer 33C is held substantially constant before and after the switching between the air- and bone-conducted sound signals and the output level in the area $N_W$ is also held substantially constant, ensuring smooth signal switching. Incidentally, the signal select processing by the signal select circuits $\mathbf{33}_1$ to $\mathbf{33}_n$ in FIG. 5 corresponds to the case where the width D of the area $N_W$ is set to zero in the processing in the modified embodiment depicted in FIGS. 10A and 10B. Hence, it can be said, in a broad sense, that the signal select circuits $\mathbf{33}_1$ to $\mathbf{33}_n$ also contribute to the mixing of signals on the basis of the estimated noise level.

In the above, when the estimation of the ambient noise level may be rough, it can be estimated by using average values of the characteristics shown in FIGS. 7 and 8. In this instance, the received signal dividing circuit 31R can be dispensed with. When the estimation of the ambient noise level may be rough, it can also be estimated by using only the speech signal from the directional microphone 14.

Figure 11:
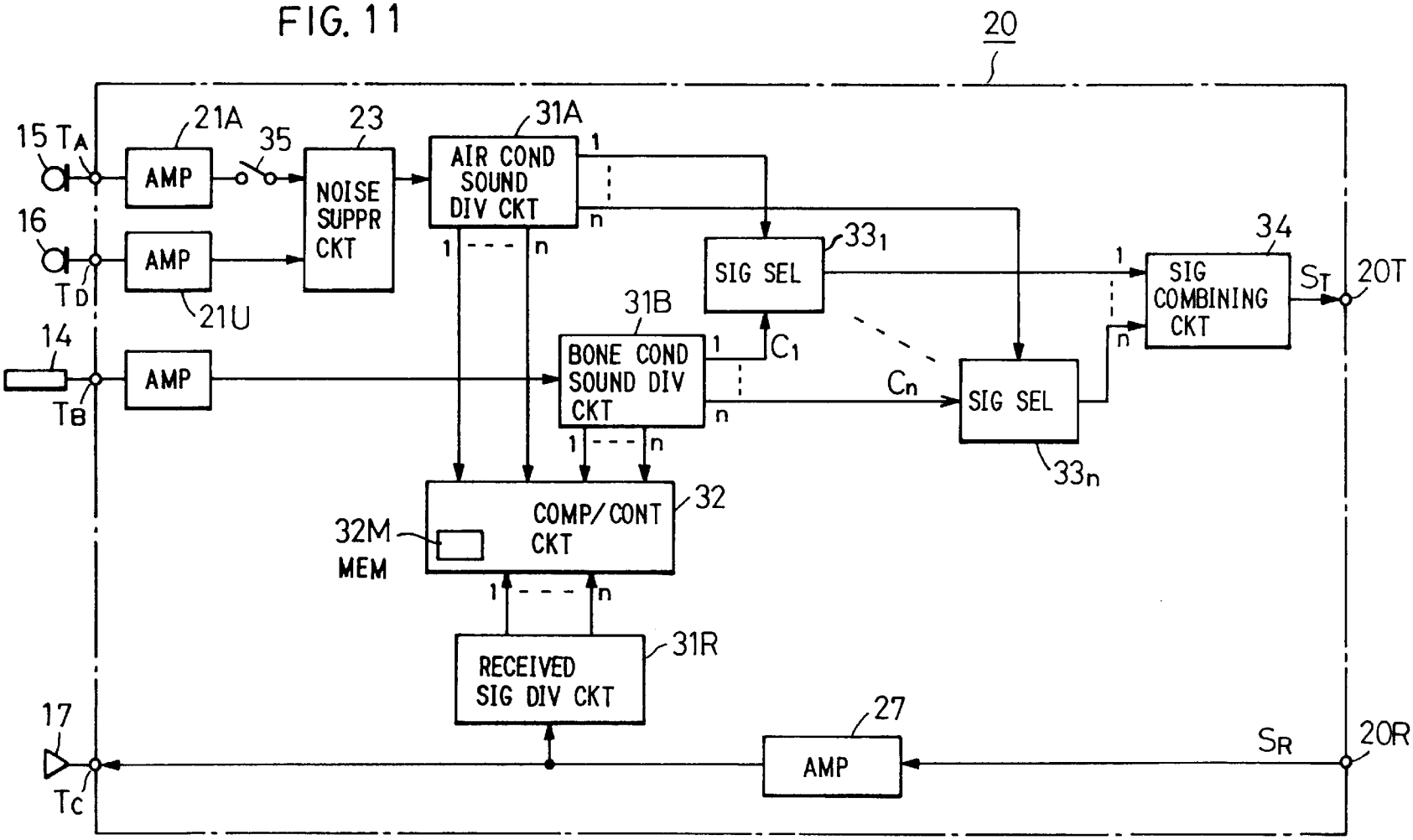
FIG. 11 is a block diagram illustrating a modified form of the FIG. 5 embodiment.

FIG. 11 illustrates in block diagram a modified form of the FIG. 5 embodiment, in which as is the case with the first embodiment of FIGS. 1 and 2, the omnidirectional microphone 16, the amplifier 21U and the noise suppressing circuit 23 are provided in association with the direction microphone 15 and the output from the noise suppressing circuit 23 is fed as an air-conducted sound signal to the air-conducted sound dividing circuit 31A. This embodiment is identical in construction with the FIG. 5 embodiment except for the above. In this embodiment, when the transmitter-receiver is in the silent or listening state, a switch 35 is opened and only the air-conducted sound signal provided via the amplifier 21U from the omnidirectional microphone 16 is applied to the noise suppressing circuit 23, from which it is fed intact to the air-conducted sound dividing circuit 31A, and the air-conducted sound signals divided into respective frequency bands are applied to the comparison/control circuit 32. As in the FIG. 5 embodiment, the comparison/control circuit 32 estimates the ambient noise levels through utilization of the relationships shown in FIG. 7 and, based on the estimated levels, generate the control signals $C_1$ to $C_n$ for signal selection (or mixing use in the case of using the FIG. 10A circuit configuration), which are applied to the signal select circuits $\mathbf{33}_1$ to $\mathbf{33}_n$ (or the signal mixing circuit 36). After this, the switch 35 is turned ON to pass therethrough the air-conducted sound signal from the directional microphone 15 to the noise suppressing circuit 23, in which its noise components are suppressed, and then the air-conducted sound signal is fed to the air-conducted sound dividing circuit 31A. This is followed by the speech sending signal processing by the same signal selection or mixing as described previously with respect to FIG. 5.

Figure 12:
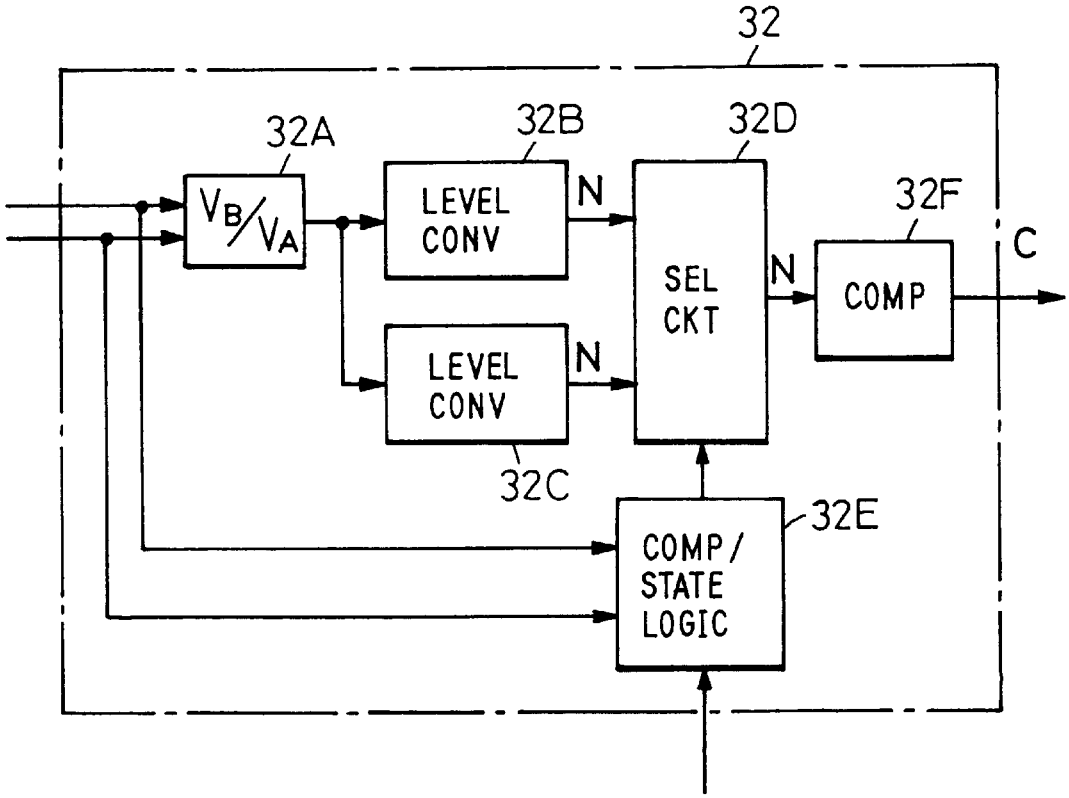
FIG. 12 is a block diagram showing the comparison/control circuit 32 in FIG. 5 or 11 constructed as an analog circuit.

Although in the embodiments of FIGS. 5 and 11 the comparison/control circuit 32 has been described to convert the signals input thereto to digital signals and generate the control signals $C_1$ to $C_n$ on the basis of the level ratio-noise level relationships stored in the memory 32M, the comparison/control circuit 32 may also be formed as an analog circuit, for example, as depicted in FIG. 12. In FIG. 12 there is shown in block form only a circuit portion corresponding to one of the divided subbands. A pair of corresponding subband signals from the air-conducted sound signal dividing circuit 31A and the bone-conducted sound signal dividing circuit 31B are both applied to a level ratio circuit 32A and a comparison/logic state circuit 32E. The level ratio circuit 32A calculates the level ratio $L_B/L_A$ between the bone- and air-conducted sound signals in an analog fashion and supplies level converter circuits 32B and 32C with a signal of a level corresponding to the calculated level ratio.

The level converter circuit 32B performs a level conversion based on the relationship shown in FIG. 7. That is, when supplied with the level ratio $V_B/V_A$, the level converter circuit 32B outputs an estimated noise level N corresponding thereto and provides it to a select circuit 32D. Similarly, the level converter circuit 32C performs a level conversion based on the relationship shown in FIG. 8. That is, when supplied with the level ratio $V_B/V_A$, the level converter circuit 32C outputs an estimated noise level corresponding thereto and provides it to the select circuit 32D. On the other hand, the comparison/state logic circuit 32E compares the levels of the corresponding air- and bone-conducted sound signals of the same subband and the level of the received speech signal with the reference levels $V_{RA}$, $V_{RB}$ and $V_{RR}$, respectively, to make a check to see if these signals are present. Based on the results of these checks, the comparison/state logic circuit 32E applies a select control signal to the select circuit 32D to cause it to select the output from the level converter circuit 32B in the case of State 1 or 2 shown in the table of FIG. 9 and the output from the level converter circuit 32C in the case of State 3 or 4.

The select circuit 32D supplies a comparator circuit 32F with the estimated noise level N selected in response to the select control signal. The comparator circuit 32F compares the estimated noise level N with the threshold level $N_{th}$ and provides the result of the comparison, as a control signal C for the subband concerned, to the corresponding one of the signal select circuits $\mathbf{31}_1$ to $\mathbf{31}_n$ in FIG. 5 or 11. In this instance, it is also possible to make a check to determine if the estimated noise level N is within the area $N_W$ or higher or lower than it as described previously with respect to FIG. 10B, instead of comparing the estimated noise level N with the threshold value $N_{th}$; if the estimated noise level N is within the area $N_W$, the control signals $C_A$ and $C_B$ corresponding to the difference between the estimated noise level N and the threshold level $N_{th}$, as is the case with Eqs. (5) and (6), are applied to the signal mixing circuit of the FIG. 10A configuration to cause it to mix the air-conducted sound signal and the bone-conducted sound signal; when the estimated noise level N is higher than the area $N_W$, the bone-conducted sound signal is selected and when the estimated noise level N is lower than the area $N_W$, the air-conducted sound signal is selected.

As described above, according to the transmitter-receiver of the embodiment shown in each of FIGS. 5 and 11, the air-conducted sound signal picked up by the directional microphone and the bone-conducted sound signal picked-up by the bone-conducted sound pickup microphone are used to estimate the ambient noise level and, on the basis of the magnitude of the estimated noise level, one of the air-conducted sound signal and the bone-conducted sound signal is selected or both of the signals are mixed together, whereby a speech sending signal of the best tone quality can be generated. Thus, the communication device of the present invention is able to transmit speech sending signals of excellent tone quality, precisely reflecting the severity and amount of ambient noise regardless of whether the device is in the talking or listening state.

While in the first and second embodiments the transmitting-receiving circuit 20 is described to be provided outside the case 11 of the ear-piece type acoustic transducing part 10 and connected thereto via the cord 18, it is evident that the transmitting-receiving circuit 20 may be provided in the case 11 of the acoustic transducing part 10.

It will be apparent that many modifications and variations may be effected without departing from the scope of the novel concepts of the present invention.

What is claimed is:

1. A transmitter-receiver comprising:

acoustic transducing means composed of a bone-conducted sound pickup microphone for picking up a bone-conducted sound and for outputting a bone-conducted sound signal, a directional microphone for picking up an air-conducted sound and for outputting an air-conducted sound signal, and a receiver for transducing a received speech signal to a received speech sound;

a low-pass filter which permits the passage therethrough of those low-frequency components in said bone-conducted sound from said bone-conducted sound pickup microphone which are lower than a predetermined cutoff frequency;

a high-pass filter which permits the passage therethrough of those high-frequency components in said air-conducted sound from said directional microphone which are higher than said cutoff frequency;

first and second variable loss circuits which impart losses to the outputs from said low-pass filter and said high-pass filter;

a comparison/control circuit which compares the output levels of said low-pass filter and said high-pass filter with predetermined first and second reference levels and, based on the results of comparison, controls the losses that are set in said first and second variable loss circuits;

a combining circuit which combines the outputs from said first and second variable loss circuits and outputs a speech sending signal; and means for supplying said received speech signal to said receiver.

2. The transmitter-receiver of claim 1, wherein said acoustic transducing means includes an omnidirectional microphone for detecting noise components, and which further comprises a noise suppressing part which combines the outputs from said directional microphone and said omnidirectional microphone to suppress said noise components and supplies said high-pass filter with said noise component suppressed output.

3. A transmitter-receiver comprising:

acoustic transducing means composed of a bone-conducted sound pickup microphone for picking up a bone-conducted sound, a directional microphone for picking up an air-conducted sound, an omnidirectional microphone for detecting noise, and a receiver for transducing a received speech signal to a received speech sound;

a low-pass filter which permits the passage therethrough of those low-frequency components in the output from said bone-conducted sound pickup microphone which are lower than a predetermined cutoff frequency;

a noise suppressing part which combines the outputs from said directional microphone and said omnidirectional microphone to suppress a noise component;

a high-pass filter which permits the passage therethrough of those high-frequency components in the output from said noise suppressing part which are higher than said cutoff frequency;

a combining circuit which mixes the outputs from said low-pass filter and said high-pass filter and outputs a speech sending signal; and means for supplying said received speech signal to said receiver.

4. The transmitter-receiver of claim 1, which further comprises: third and fourth variable loss circuits connected to the output side of said combining circuit and the input side of said received speech signal supplying means, for controlling the levels of said speech sending signal and said received speech signal, respectively; and a second comparison/control circuit which compares the level of said speech sending signal to be fed to said third variable loss circuit and the level of said received speech signal to be fed to said fourth variable loss circuit with predetermined third and fourth reference levels, respectively, and on the basis of the results of comparison, controls the losses that are set in said third and fourth variable loss circuits.

5. The transmitter-receiver of claim 2 or 3, wherein said noise suppressing part comprises: a first amplifier for amplifying said air-conducted sound signal from said directional microphone; a second amplifier for amplifying said noise components from said omnidirectional microphone; and a noise suppressor circuit which adds together the outputs from said first and second amplifiers in a 180° out-of-phase relation to each other to generate an air-conducted sound signal with said noise components suppressed and applies it to said high-pass filter.

6. A transmitter-receiver comprising:

acoustic transmitting means composed of a bone-conducted sound pickup microphone for picking up a bone-conducted sound and for outputting a bone-conducted sound signal, air-conducted sound pickup microphone means for picking up an air-conducted sound and for outputting an air-conducted sound signal, and a receiver for transducing a received speech signal to a received speech;

comparison/control means which estimates a level of ambient noise, compares said estimated level with a predetermined threshold level and generates a control signal on the basis of the results of comparison; and speech sending signal generating means which responds to said control signal to control additive mixing of said air-conducted sound signal from said air-conducted sound pickup microphone means and said bone-conducted sound signal from said bone-conducted sound pickup microphone to generate a speech sending signal;

wherein said comparison/control means generates, as said control signal, a signal indicating whether said estimated noise level is higher or lower than said threshold level; said speech sending signal generating means includes signal select means responsive to said control means to select either one of said bone-conducted sound signal and said air-conducted sound signal; and said speech sending signal generating means generates said speech sending signal from said selected signal.

7. A transmitter-receiver comprising:

acoustic transmitting means composed of a bone-conducted sound pickup microphone for picking up a bone-conducted sound and for outputting a bone-conducted sound signal, air-conducted sound pickup microphone means for picking up an air-conducted sound and for outputting an air-conducted sound signal, and a receiver for transducing a received speech signal to a received speech;

comparison/control means which estimates a level of ambient noise, compares said estimated level with a predetermined threshold level and generates a control signal on the basis of the results of comparison; and speech sending signal generating means which responds to said control signal to control additive mixing of said air-conducted sound signal from said air-conducted sound pickup microphone means and said bone-conducted sound signal from said bone-conducted sound pickup microphone to generate a speech sending signal;

wherein said comparison/control means is a means which, when said estimated noise level is within an area of a fixed width defined about said threshold level, supplies said speech sending signal generating means with a control signal for mixing said air-conducted sound signal and said bone-conducted sound signal at a ratio corresponding to said estimated noise level; and said speech sending signal generating means includes a means responsive to said control signal to mix said air-conducted sound signal and said bone-conducted sound signal at said ratio.

8. The transmitter-receiver of claim 6, or 7 wherein said comparison/control means includes means for holding a relationship between the ambient noise level and at least the level of said air-conducted sound signal in non-talking states; and said comparison/control means is a means which obtains, as said estimated noise level, a noise level corresponding to the level of the air-conducted sound signal during the use of said transmitter-receiver based on said relationship, compares said estimated noise level with said threshold level and generates said control signal on the basis of the result of comparison.

9. The transmitter-receiver of claim 8, wherein said relationship is the relationship between the ambient noise level and the level ratio of said bone-conducted sound signal versus said air-conducted sound signal; and said comparison/control means includes means which obtains a level ratio between said bone-conducted sound signal and said air-conducted sound signal and obtains the noise level corresponding to said level ratio, as said estimated noise level, from said relationship.

10. The transmitter-receiver of claim 6 or 7, wherein said comparison/control means includes means for holding a relationship between the ambient noise level and at least the level of the air-conducted sound signal in a talking state; and said comparison/control means is a means which obtains, as said estimated noise level, a noise level corresponding to the level of said air-conducted sound signal during the use of said transmitter-receiver based on said relationship, compares said estimated noise level with said threshold value and generates said control signal on the basis of the result of comparison.

11. The transmitter-receiver of claim 10, wherein said relationship is the relationship between the ambient noise level and the ratio of bone-conducted sound signal level versus air-conducted sound signal level; and said comparison/control means includes means which obtains a level ratio between said bone-conducted sound signal and said air-conducted sound signal and obtains the noise level corresponding to said level ratio, as said estimated noise level, from said relationship.

12. The transmitter-receiver of claim 6 or 7, wherein said comparison/control means includes means for holding a first relationship between the ambient noise level and at least the level of said air-conducted sound signal in non-talking states and a second relationship between the ambient noise level and at least the level of said air-conducted sound signal in a talking state; and said comparison/control means is a means which compares the level of said received speech signal and at least one of the level of said air-conducted sound signal and the level of said bone-conducted sound signal with predetermined first and second reference level values, respectively, to determine if said transmitter-receiver is in a talking or listening state, and on the basis of said first or second relationship corresponding to the results of comparison, obtains, as said estimated noise level, a noise level corresponding to at least said air-conducted sound signal, compares said estimated noise level with said threshold value, and generates said control signal on the basis of the result of comparison.

13. The transmitter-receiver of claim 12, wherein said first and second relationships are relationships between the ambient noise level and the level ratio of said bone-conducted sound signal versus said air-conducted sound signal in a non-talking state and in a talking state, respectively; and said comparison/control means includes means which obtains the level ratio between said bone-conducted sound signal and said air-conducted sound signal and obtains the estimated noise level corresponding to said level ratio from either one of said first and second relationships.

14. The transmitter-receiver of claim 6 or 7 which further comprises first and second signal dividing means for dividing each of at least said air-conducted sound signal and said bone-conducted sound sending signal into a plurality of frequency bands; said speech sending signal generating means comprises a plurality of signal mixing circuits each of which is supplied with said air-conducted sound signal and said bone-conducted sound signal of the corresponding frequency band from said first and second signal dividing means, then mixes them in accordance with a band control signal and outputs the mixed signal, and a signal combining circuit which combines the outputs from said plurality of signal mixing circuits and outputs the combined signal as said speech sending signal; and said comparison/control means is a means which is supplied with at least said air-conducted sound signals of the corresponding frequency bands from said first signal dividing means, estimates ambient noise levels of said frequency bands from said air-conducted sound signals, compares said estimated noise levels with a plurality of threshold values predetermined for said plurality of frequency bands, respectively, and generates band control signals on the basis of the results of comparison.

15. The transmitter-receiver of claim 14, wherein said comparison/control means includes means for holding a relationship between said ambient noise levels in said plurality of frequency bands in non-talking states and at least the levels of said air-conducted sound signals of the corresponding frequency bands; and said comparison/control means is a means which obtains, as said estimated noise level of each frequency band, a noise level corresponding to the level of the air-conducted sound signal during the use of said transmitter-receiver based on said relationship, compares said estimated noise level with said threshold value, and generates said band control signal of said each frequency band on the basis of the result of comparison.

16. The transmitter-receiver of claim 15, wherein said relationship is the relationship between the ambient noise level and the level ratio of said bone-conducted sound signal versus said air-conducted sound signal in each frequency band in non-talking states; and said comparison/control means includes means which obtains a level ratio between said bone-conducted sound signal and said air-conducted sound signal in each frequency band and obtains the noise level corresponding to said level ratio, as said estimated noise level of said each frequency band, from said relationship.

17. The transmitter-receiver of claim 14, wherein said comparison/control means includes means for holding a relationship between ambient noise levels in said plurality of frequency bands and at least levels of said air-conducted sound signals of the corresponding frequency bands in talking states; and said comparison/control means is a means which obtains, as said estimated noise level of each frequency band, a noise level corresponding to the level of the air-conducted sound signal during the use of said transmitter-receiver based on said relationship, compares said estimated noise level with said threshold value, and generates said band control signal of said each frequency band on the basis of the result of comparison.

18. The transmitter-receiver of claim 17, wherein said relationship is the relationship between the ambient noise level and the level ratio of said bone-conducted sound signal versus said air-conducted sound signal for each frequency band in said talking states; and said comparison/control means includes means which obtains a level ratio between said bone-conducted sound signal and said air-conducted sound signal for each frequency band, and obtains the noise level corresponding to said level ratio, as said estimated noise level of said each frequency band, from said relationship.

19. The transmitter-receiver assembly of claim 14, wherein said comparison/control means includes means for holding a first relationship between the ambient noise level and at least the level of said air-conducted sound signal in each corresponding frequency band in non-talking states and a second relationship between the ambient noise level and at least the level of said air-conducted sound signal in a talking state; and said comparison/control means is a means which compares the level of said received speech signal and at least one of the level of said air-conducted sound signal and the level of said bone-conducted sound signal in each frequency band with predetermined first and second reference level values, respectively, for said frequency band to determine if said transmitter-receiver is in a talking or listening state, and on the basis of said first or second relationship corresponding to the result of determination, obtains, as said estimated noise level, a noise level corresponding to at least the level of said air-conducted sound signal, compares said estimated noise level with said threshold value, and generates said control signal of said each frequency band on the basis of the result of comparison.

20. The transmitter-receiver of claim 19, wherein said first and second relationships for each frequency band between the ambient noise level and the level ratio of said bone-conducted sound signal versus said air-conducted sound signal in a non-talking state and in a talking state, respectively; and said comparison/control means includes means which obtains the level ratio between said bone-conducted sound signal and said air-conducted sound signal for each frequency band and obtains the estimated noise level corresponding to said level ratio from either one of said first and second relationships.

21. The transmitter-receiver of claim 6 or 7, which further includes a directional microphone and an omnidirectional microphone as said air-conducted sound pickup microphone and noise suppressing means, said noise suppressing means being a means which, during a silent state and a listening state, outputs a signal from said omnidirectional microphone as said air-conducted sound signal representing a noise signal and, during a talking state, combines signals from said directional microphone and said omnidirectional microphone and outputs said combined signal as said air-conducted sound signal with noise suppressed.

* * * * *